US005228013A

United States Patent [19]

Bik

[11] Patent Number: 5,228,013

[45] Date of Patent: Jul. 13, 1993

[54] CLOCK-PAINTING DEVICE AND METHOD FOR INDICATING THE TIME-OF-DAY WITH A NON-TRADITIONAL, NOW ANALOG ARTISTIC PANEL OF DIGITAL ELECTRONIC VISUAL DISPLAYS

[76] Inventor: Russell J. Bik, 1458 Shasta Ave., San Jose, Calif. 95126

[21] Appl. No.: 819,443

[22] Filed: Jan. 10, 1992

[51] Int. Cl.[5] ..... G04B 19/00

[52] U.S. Cl. ..... 368/223; 368/239; 368/82

[58] Field of Search ..... 368/223–239, 368/77, 296, 82, 240

[56] References Cited

U.S. PATENT DOCUMENTS 3,514,938 6/1970 Miller ..... 368/223

3,798,892 3/1974 Lukens ..... 368/223

*Primary Examiner*—Bernard Roskoski

*Attorney, Agent, or Firm*—Thomas E. Schatzel

[57] ABSTRACT

A microelectronic-based timekeeping apparatus having several display means, such as liquid crystal displays, that change color to indicate the time-of-day, and user accessible switches for setting modes of operation, are mounted within an aluminum frame. Time-of-day is represented by the dynamically changing relationship among the several display means. Display means consist of light valves alone, or light valves in combination with a backlighting means. The apparatus is suitable for integration with a work of abstract art and may be free-standing or hung on a wall.

13 Claims, 4 Drawing Sheets

CLOCK-PAINTING DEVICE AND METHOD FOR INDICATING THE TIME-OF-DAY WITH A NON-TRADITIONAL, NOW ANALOG ARTISTIC PANEL OF DIGITAL ELECTRONIC VISUAL DISPLAYS

BACKGROUND OF THE INVENTION

1. Field of the Invention

The invention relates generally to electronic timekeeping and more particularly to an electronic timekeeping system incorporated into a dynamically changing piece of artwork wherein the time-of-day may be determined by interpreting the relationships among various elements of the artwork according to a programmable set of rules.

2. Description of the Prior Art

Among the enormous variety of timepieces that exist today, the vast majority are either analog or digital. Analog clocks display time in the traditional way by moving hands or other shapes. Digital clocks are a newer phenomenon and display numbers directly by liquid crystals (LCDs) or light emitting diodes (LEDs). Children often find it easy to "tell" the time with digital clocks. Almost all clocks have some decorative dial or face. But very few timepieces truly integrate their timekeeping function with the associated art work. Clocks have long been mounted in or on front of pictures, many use standard analog hands and are clearly not an integral part of the art. The hands of clocks have been substituted by various arrangements of lights, but these variations still use a basic clock face. Crude mechanical devices have been devised that use rolling balls, dripping water and the like to indicate the time, and although these could be considered to be examples of integrating timekeeping with art, they have many shortcomings.

New semiconductor digital electronics and LCD technology now make it possible to use time-as-art in an entirely novel way. Wall-mounted devices that appear to be original pieces of high-tech abstract art can be made to change their appearances over time. And if built according to the present invention, can provide accurate time to those who know the secret of the displayed scenes.

SUMMARY OF THE PRESENT INVENTION

It is therefore an object of the present invention to provide a timekeeping apparatus suitable for integral use with a piece of decorative artwork.

It is a further object of the present invention to provide a means of displaying the time-of-day without the use of moving hands or digital number displays.

It is a further object of the present invention to provide wall-mountable decorative artwork incorporating a means for displaying the time-of-day.

It is a further object of the present invention to provide the integrated timekeeping/artwork clock-painting with low manufacturing costs.

Briefly, the present invention includes a triangular-shaped cast aluminum framework having front and back sides, in which several apertures are formed. A display means such as an LCD structure is mounted within each of these apertures such that access for LCD power and control signals is provided via the back side, and the results of LCD switching activity are visible from the front side. The display means consist of light valves alone, or light valves in combination with a backlighting, or illumination, means such as electroluminescent displays. The framework further includes means for mounting electronic timekeeping apparatus including a power supply, and means for facilitating wall-mounting of the clock-painting. The surface of the front side provides a "canvas" upon which decorative artwork is applied.

An advantage of the clock-painting of the present invention is that a timekeeping apparatus is integrated with a piece of decorative artwork.

Another advantage is that the time-of-day is displayed without the use of moving hands or digital number displays.

A further advantage is that the clock-painting of the present invention is wall-mountable.

And a still further advantage is that the clock-painting of the present invention is relatively inexpensive to manufacture in low volume.

These and many other objects and advantages of the present invention will no doubt become obvious to those of ordinary skill in the art after having read the following detailed description of the preferred embodiments which are illustrated in the various drawing figures.

IN THE DRAWINGS

Figure 5:
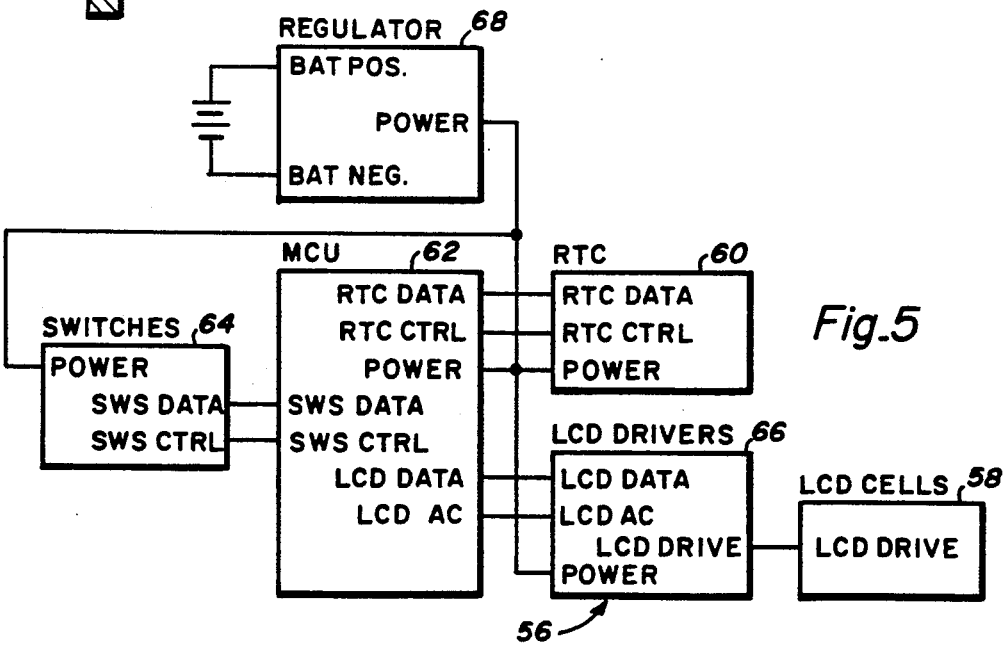
Figure 4:
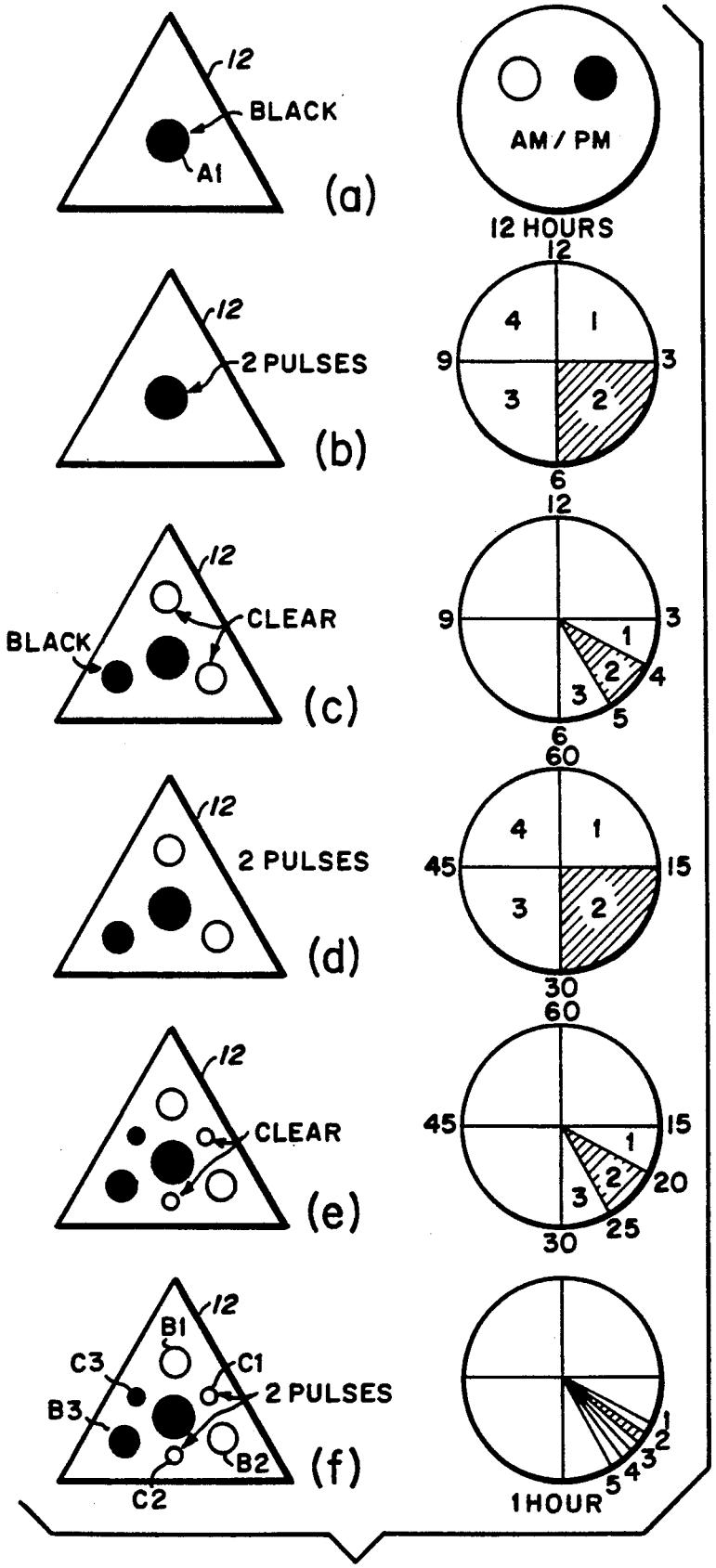
Figure 6:
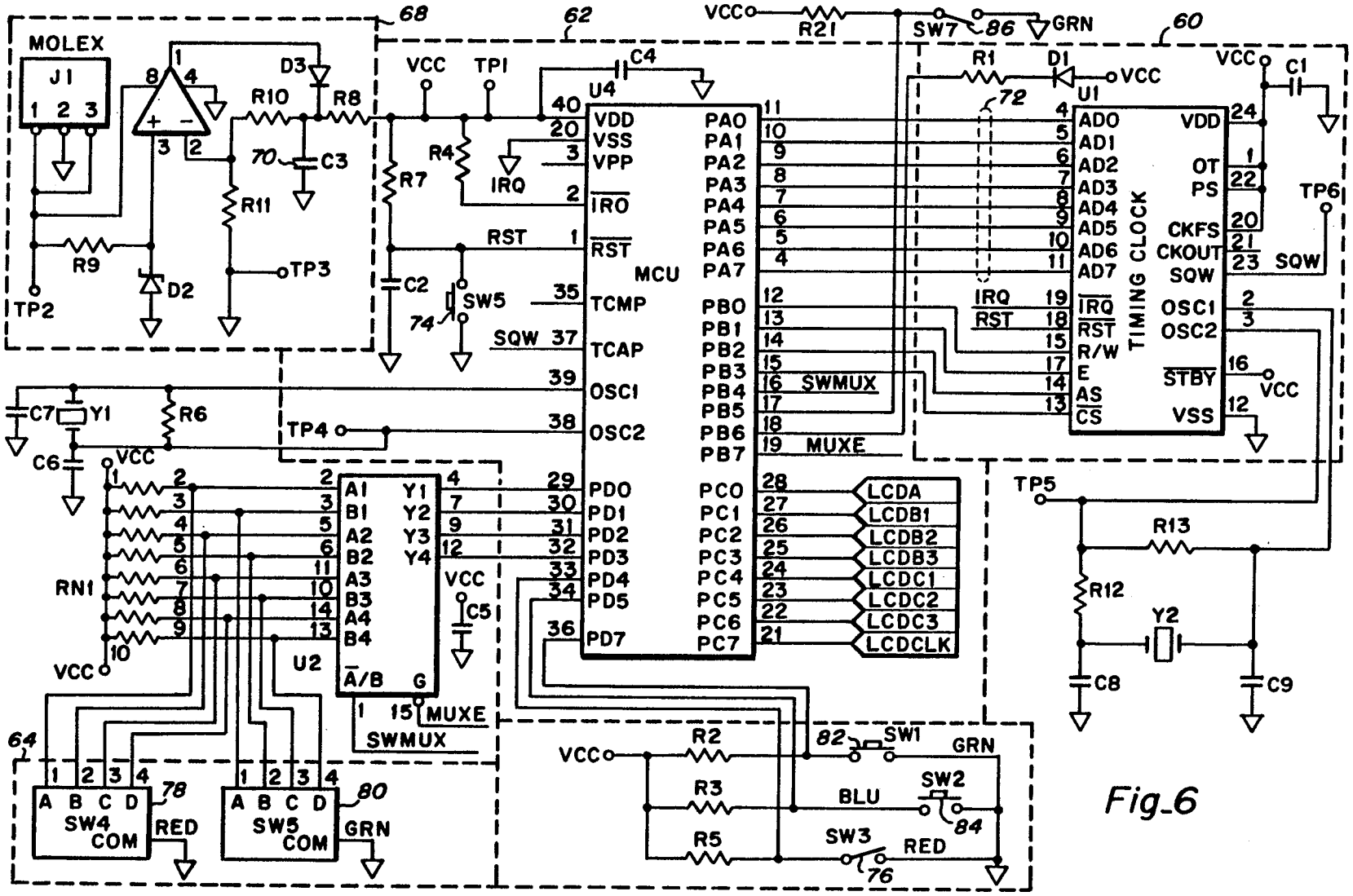
Figure 7:
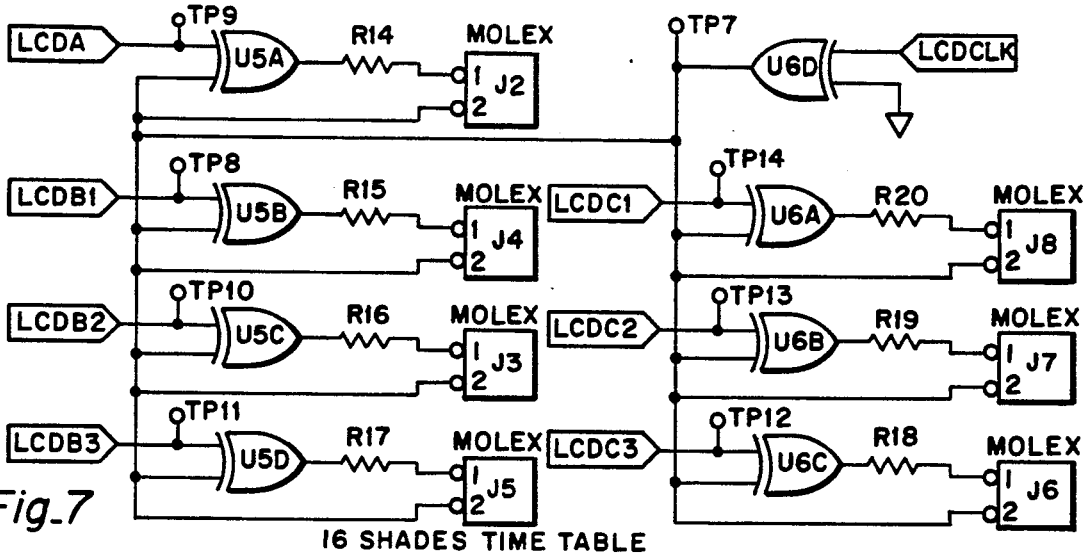
Figure 8:
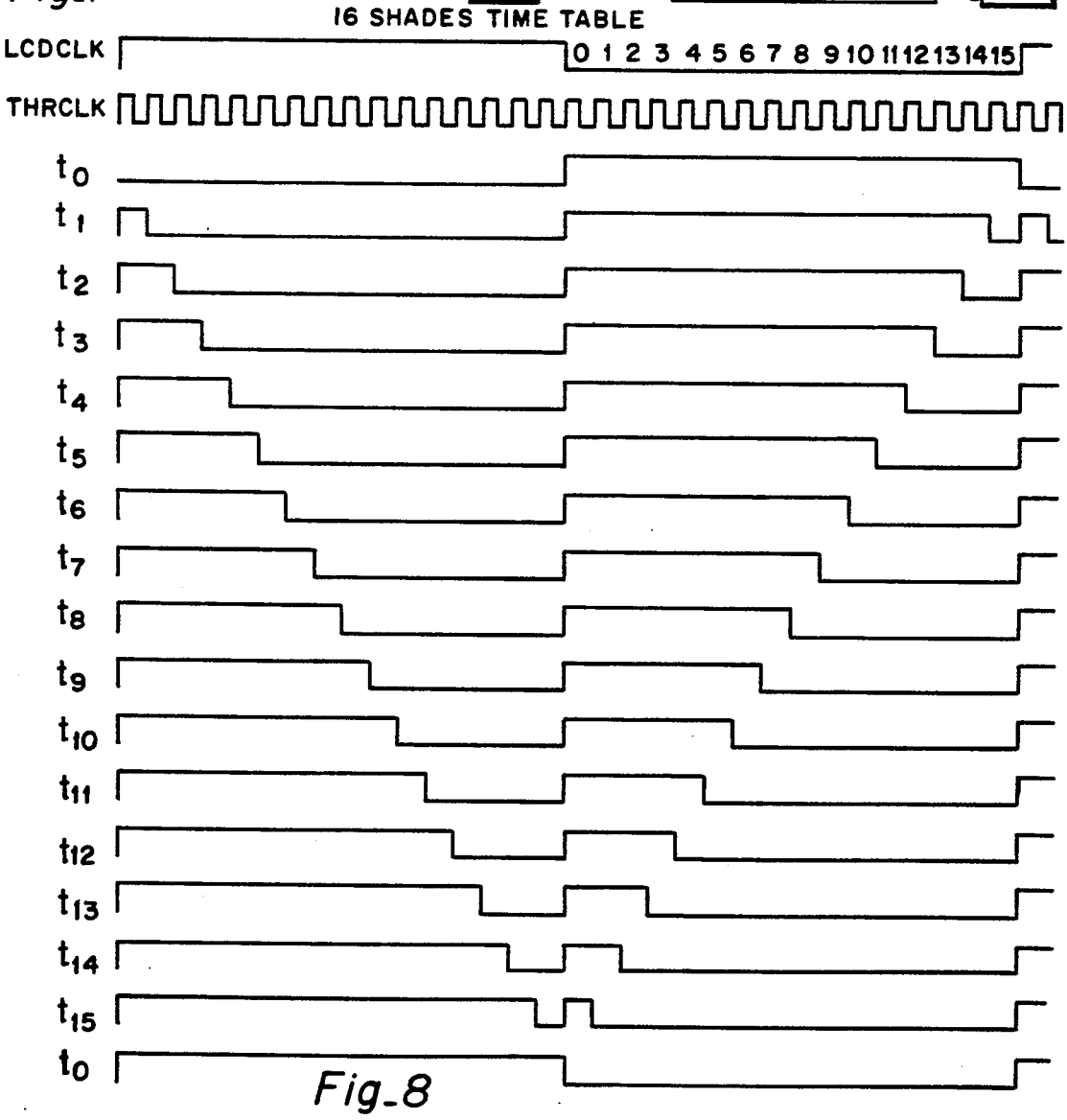

FIGS. 4(*a*)–4(*f*) illustrate the six step procedure for reading embedded time-of-day information according to the present invention;

FIG. 5 is a block diagram of a controller circuit according to the present invention;

FIGS. 6 and 7 are schematic diagrams of a controller circuit according to the present invention; and FIG. 8 is a timing diagram showing the shades timing.

DETAILED DESCRIPTION OF THE PREFERRED EMBODIMENTS.

Figure 1:
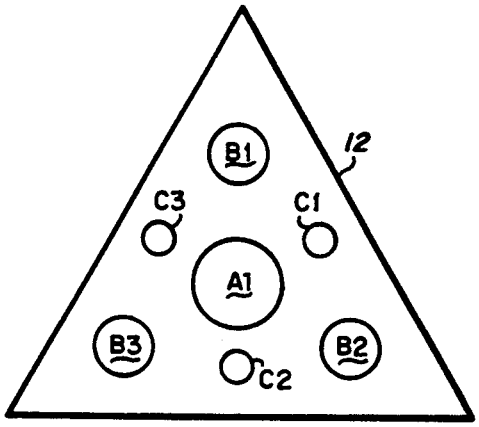
FIG. 1 is a front view of a clock-painting in accordance with the present invention.

Referring to FIG. 1, a framework 12 which is an embodiment of the present invention is formed in the shape of an equilateral triangle approximately 42 inches on each side. The base material is cast aluminum approximately a quarter of an inch thick. The perimeter of the triangle is shaped to form its own frame, with a raised border that is machined smooth. There are seven circular openings, or holes, A1, B1, B2, B3, C1, C2, and C3, in the casting shown in FIG. 1. The edges of holes may also have raised and machined edges. The area between the holes in the casting is a remaining portion of the "canvas" and consists of an individualized sprayed-on textures and color combinations.

The circular hole radii are as follows: 6.4 inches for A1, 5.2 inches for B1, B2, and B3, and 3.7 inches for C1, C2, and C3. Opening A1 is centered in the triangle 12. Openings B1, B2, and B3 are centered halfway between the center of opening A1 and the angles formed by each side of the triangle. Openings C1, C2 and C3 are centered between the perimeter of opening A1 and the midpoint of each side of the triangle.

Figure 2:
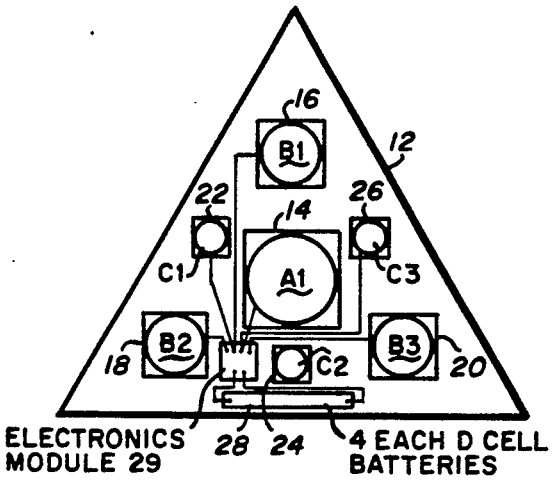
FIG. 2 is a back view of a clock-painting in accordance with the present invention.

In FIG. 2, opposite each opening on the back side of aluminum casting 12, there are a series of square cavities. These cavities each provide protection and maintain alignment for an attached display means. In this embodiment, LCD display sandwiches are used as the display means. The drive electronics unit 29 includes a power regulator, clock, microprocessor, and driver circuitry. The back of the aluminum casting 12 is tapped in various locations for mounting hardware used in the cavities and to mount and ship the device itself.

The present invention contemplates all types of LCDs as display means. For example reflective, transmissive, dichroic, twisted nematic, super-twisted, and guest-host type of LCDs may be incorporated as display means. The present invention further contemplates display means other than LCDs such as ferro-electric liquid crystals (FLCs) and electroluminescent (EL) displays. Additionally, these various types of display means may be used singly or in combination. For example, electroluminescent displays could be used alone and pulsed on and off, or alternatively leave an electroluminescent backlight on and pulse an LCD on and off. In fact, this latter combination is desirable because backlighting LCDs would not require any modification to the disclosed control electronics. All that would be required for an EL backlit, LCD system is a source of power connected to the EL display means. Such a combination would produce a visually impressive display that could be viewed in the dark.

An aluminum casting is preferable because, as such, it eliminates the need for a separate frame and glass while providing the ability to generate a painting surface and LCD mounting cavities with relatively low tooling and small volume production costs.

Figure 3:
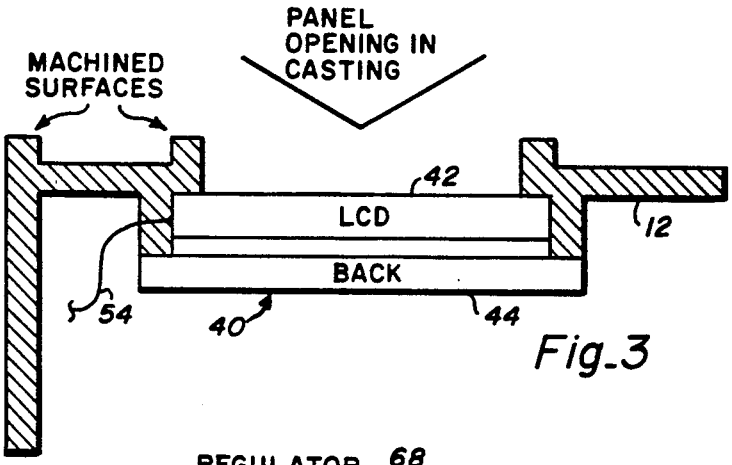
FIG. 3 is a cross-sectional view of the display means according to one embodiment of the present invention.

Referring to FIG. 3, behind each opening in casting 12 and located within its own cavity is a reflective twisted-nematic liquid crystal display 42. The display is secured to the casting by shock-absorbing adhesive material. A protective cover 44 is attached by silicone rubber adhesive to the back of the cavity. Wires 54 lead through an opening in the cavity from each LCD to the electronics module 29.

Typically, when an LCD is "off", it is clear; and when the LCD is "on" it is dark, opaque, or black. The LCD panel 42 can be switched on/off with 3.0 volts DC. The switching function can be instantaneous, or it can be done slowly creating a "dissolve" effect, as is commonly seen on network TV when changing from one scene to the next. The dissolve effect is desirable in this case to produce a slow pulsing indication. The time required to complete each LCD pulse, the time between pulses, and the time between the pulse sequence are preferably user programmable.

The LCD used in a present embodiment comprises two pieces of glass between which a round reservoir seven microns thick has been silk screened. After the two pieces of glass are fitted together, the reservoir is filled with liquid crystal and sealed. Polarizers are fitted to the front and back surfaces of the glass with the backside polarizer incorporating a gold or silver aluminized reflector. Gold and silver are the only two colors presently available commercially.

Controller

FIG. 5 is a block diagram of a clock painting controller of the present invention, referred to by the general reference numeral 56, which keeps track of the real time and drives seven LCD cells 58 to display the time of the day. A real time clock chip (RTC) 60 is used to simplify keeping track of the time and a microcontroller unit (MCU) 62 is used to access the RTC 60, encode the time, and to drive the LCD cells 58 and provide data to an LCD driver 66.

Microcontroller unit (MCU) 62 is used to interface with a real time clock (RTC) 60, and access the actual time. After the MCU 62 reads the time from the RTC 60, it encodes the time in the proper sequence of pulses, and then drives the corresponding LCD cells 58 through the LCD drivers 66. MCU 62 also interfaces with a series of switches 64, 76, 82, and 84 that a user can access to set a new time value in the RTC 60, or to place the clock painting controller 56 into a particular mode of operation.

The values for time-hour and time-minute are set by a switch network 64 having two rotary switches and two momentary switches accessible to a user. The rate of fade from ON to OFF, and from OFF to ON is also user selectable through switch 86. In particular, the user may choose between a fast fade mode of approximately 0.75 seconds and a slow fade mode of approximately 3.25 seconds. There is also a mode (more fully described below) that allows a user to change the batteries of a power regulator 68 without losing the contents of the RTC memory 60.

The controller is preferably powered from a series of four alkaline 'D' cell batteries. These batteries are connected in series to yield an input voltage of about six volts. The battery voltage is regulated to approximately 3.30 volts DC $\pm 5\%$ by a linear regulator that ensures a stable voltage to the controller and the LCD drivers.

When the battery voltage is less than about 4.3 volts the regulator 68 can no longer output a regulated 3.3 volts, however the controller 56 will continue to keep track of the time properly though the voltage may not be high enough to drive the LCD cells 58 full on. Common commercially available alkaline batteries can provide approximately 5,000 hours of operation with a 2.5 mA current draw before the voltage from four of them in series will drop below about 4.3 volts.

Referring to the circuit diagram of FIG. 6, a 10,000 microfarad ($\mu$F) capacitor 70 is located at the output of the regulator 68 to allow the RTC 60 to keeping running for approximately 60 seconds after the batteries are removed and while the MCU 62 is in the POWER DOWN MODE. (The POWER DOWN MODE is explained in detail below.) In this way the batteries may be changed without having to reset the clock as long as the battery change operation is completed within 60 seconds.

An MC146818 real time clock chip manufactured by Motorola is a suitable chip to use for the RTC 60. The RTC interfaces to the MCU 62 through a multiplexed eight-line signal bus (AD0–AD7) 72 and four control lines, (CS, AS, E, and R/W). The MCU 62 outputs the address of the RTC registers to the eight signal lines in a first part of a bus cycle. Next, data is written to or read from the registers in a second part of the same bus cycle. The state of the control lines CS, AS, E AND R/W determines what parts of the bus cycle are being executed and whether the transfer is a read or write operation. The widely distributed and commercially available data sheet for the Motorola MC146818 is incorporated herein by reference, it provides additional detailed timing information.

The RTC 60 has an internal memory that holds data representing the time-of-day hours, minutes, and seconds. In the present embodiment, this internal memory has 50 bytes of memory on-chip. During a time update process, which is typically once every second, these registers are not accessible by the MCU 62. However, in this embodiment, the MCU 62 requests the RTC 60 to signal when the update is complete so that the MCU 62 can reliably access the RTC register space.

The RTC 60 also generates a square wave having a programmable frequency as an output signal. Immediately after the controller 56 is initialized, this square wave output is programmed to operate at 4.096 KHz. The square wave output is used to interrupt the MCU 62 and to provide a time base needed to drive the LCD cells 58.

The controller unit 56 includes several user-accessible switches for selecting various modes of operation. A reset switch 74 (SW6) is a momentary switch that when depressed causes the MCU 62 to abort the current process and to go into the initialization mode. A set/run switch 76 is a toggle maintain switch that when set to one or the other position causes the MCU 62 to run a set mode or a run mode sequence in controller software. The switch network 64 includes time-setting switches comprising two ten-position rotary switches 78 and 80, and two momentary switches 82 and 84 that the MCU 62 reads to know how a user wants it to set the hours and minutes of the RTC 60 while in set mode. A fade switch 86 (SW7) is a toggle switch that the MCU 62 reads during run mode to select either a fast fade rate or a slow fade rate depending on the position of this toggle switch.

The MCU 62, is preferably a Motorola MC68HC705C8 and is widely available. This device is a member of the Motorola 6805 family of microcontrollers. The MCU has twenty-four I/O lines and seven input lines which are grouped as indicated in the following table.

TABLE I

| | |
|---|---|
| PA0–7 | RTC data/address lines |
| PB0–7 | RTC control lines and miscellaneous lines |
| PC0–7 | LCD cell data lines |
| PD0–5, 7 | switches |

An A-PORT and the first four lines of a B-PORT address the RTC 60 by toggling the data, address, and control lines under software control. The timing and phase relationship between the different signals for both write and read cycles are those defined by the manufacturer of the RTC chip (e.g., by Motorola). The remaining four lines of the B-PORT are used to control hardware, drive an LED, and to read the state of the fade switch 86.

The first seven I/O lines of a C-PORT are used as outputs to drive the LCD cells, one line per cell. The remaining one I/O line is to provide a 64 Hz clock as an output. This clock is known as the LCD AC inversion and is used to remove any DC component that exists across the LCD and to prevent an ion migration from one electrode to the other.

All the switches are monitored through the D-PORT.

Clock painting controller 56 has four modes of operation which are initialization mode, set mode, run mode, and power down mode. Each of these modes enables a series of tasks that the user can select to initialize the MCU 62 to a known condition, to change the time-of-day stored in the RTC 60, to display and keep track of the time-of-day, and to put the MCU 62 in a power-down mode.

When reset switch 74 is depressed, the MCU 62 aborts the current process and starts executing the control program from its initial entry point. All the LCD cells 58 are turned off until the program turns them on again when the run mode software routines are executed. The contents of the RTC memory are not altered by this initialization. After necessary housekeeping and variable initialization has been taken care of, the software checks the state of the set/run switch 76 to determine whether set mode or run mode software routines should be executed.

The set mode is selected by setting the set/run switch 76 to the "1" position. If this mode is selected while the run mode routines are executing, the MCU 62 will not begin execution of the set mode routines until after the C-cells are driven. In this embodiment, a short cut for entering the set mode is provided, comprising the steps of depressing the reset switch 74 right after setting the set/run switch 76 to the "1" position. The RTC memory is not altered by this procedure.

While in the set mode, a user can change the time-hour and time-minute by means of two rotary switches, units switch 78 and tens switch 80, and two momentary switches, hour switch 82 and minute switch 84. The time-hour is selected by setting the unit switch 78 and the tens switch 80 to the desired hour within the range 0–23. The MCU 62 executes a store operation to write the entered time-hour value into the RTC memory after the hour switch 82 is depressed. If a time-hour value greater than twenty-three is entered, then a red LED will turn on to notify a user of improper data entry. The red LED will turn off after a valid time-hour value has been entered. The time-minute is selected by setting the unit switch 78 and the tens switch 80 to the desired minute, within the range of 0–59. The MCU 62 writes the entered time-minute value into the RTC memory after the minute switch 84 has been depressed. If a time-minute value greater than 59 is entered, then the red LED will turn on to notify a user of improper data entry. The red LED will turn off when a valid time-minute value has been entered.

The run mode is selected by setting the set/run switch 76 to the "2" position. Before reading the time from the RTC 60, the MCU 62 checks the state of the units switch 78 to enter the power down mode, and the state of the FADE switch 86 to select a fast or a slow fade (dissolve).

After the MCU 62 reads the time from the RTC 60, the MCU 62 determines which of the cells 58 to turn on and off, and how many times to pulse them. Next, the several A-cell, B-cell and C-cell are turned on and pulsed an appropriate number of times to represent the time-of-day, according to a set of rules described more fully below. According to the time-of-day representation rules of this embodiment, the C-cells are the last to be pulsed in a time-of-day representation display cycle. After the last C-cell has been pulsed, the MCU 62 begins the time-of-day representation display cycle again.

The size of the A-cell will be determined by practical limitations in the LCD fabrication process. A diameter of 6.4 inches has been found to be among the largest that can be economically produced. In addition, the human eye judges the relative sizes of circles based on their respective areas, rather that their respective diameters. The other smaller cell sizes should preferably be some fraction of the area of the largest cell. For example, B-cell can have an area two-thirds that of A-cell, and C-cell can have an area one-third that of A-cell.

The power down mode is selected from within the run mode by setting the units switch 78 to the "8" position. When the MCU 62 detects this setting it executes a stop instruction that disables all the clocks within the MCU 62 thus entering the lowest power consumption mode. In this state, the batteries can be removed and the 10,000 μF capacitor 70 will maintain the power supply voltage to the RTC 60 for approximately sixty seconds. The power down mode is terminated by setting the units switch 78 to a position other than "8" followed by depressing the reset switch.

As shown in FIG. 7, each LCD cell is driven by the output of a two-input EXCLUSIVE OR (XOR) gate and the LCD AC inversion signal. Each XOR gate has the LCD AC inversion signal as one of its inputs and a data signal from the C-PORT as its other input. This arrangement permits each LCD cell to be driven on or off and further permits the polarity of voltage across the LCD cell to be switched 64 times/second.

An LCD cell is turned on or off when the corresponding C-PORT data signal is driven to a TTL high or low level. This switching occurs regardless of the state of the LCD AC inversion signal.

FIG. 8 shows the control signal timing related to LCD cell fading, whether on-to-off or off-to-on. Fading control is accomplished by pulse width modulation (PWM) of the data signal corresponding to each LCD cell at a frequency of 64 Hz. The rate of change of the PWM determines whether the fade time is fast or slow. This method may also be described as a modified form of phase clipping, similar in principle to that used in solid state light dimmers. The difference here is that instead of varying the turn-off point of a 60 Hz sinusoidal waveform, the duty cycle of a 64 Hz square wave is controlled. The results produced are the same as those achieved by the phase clipping method mentioned above. For phase clipping systems, the sooner in the cycle the sine wave is turned on, the brighter the light. For the square wave PWM case, the longer the pulse width, the greater will be the change-of-state for the LCD.

Clock-Painting Embedded Time-of-day Information

Several ways to code and extract time-of-day information from a clock-painting can be devised. The following is one example of how it has been done by the inventor. Since the invention combines art, it can be expected that once the present invention is understood, many ways will become apparent to artists who are trying to provide a variety of visually interesting and pleasing scenes. While plain round indicators are described here, it is entirely possible to have objects within a landscape or portrait appear, blink, or disappear. These objects could include individual mountain tops, lakes, trees, people, animals or even facial features such as eyes, ears, noses, teeth, and whiskers.

When an LCD panel is turned off, the display is clear and a background color can show through. When an LCD panel is turned on, the display is black The choice of background colors is unimportant as long as the colors are distinct from the black LCD of condition. The uppermost B panel and upper right C panel will normally be clear.

Periodically, the LCD display panels will pulsate in a sequence beginning with the A panel, followed by all clear B panels simultaneously, followed by all clear C panels simultaneously. Only clear panels pulsate, and all clear panels of a particular size pulsate together.

The LCD panels are read from Large (e.g. A1 panel), to Medium (e.g. B panels), to Small (e.g. C panels). The color of each panel is read first followed by the number of pulsations. In other words, the data extraction sequence is: A-color, A-pulses, B-color, B-pulses, C-color, C-pulses. Each of these steps yields data which is related to a standard clock dial and used to convert the reading into the conventional expressions of time.

As shown in FIG. 4(*a*), panel A1 normally represents AM or PM, with black meaning PM and clear meaning AM. Periodically, panel A1 pulses (FIG. 4(*b*)) between one and four times to identify a three hour quadrant within the larger twelve hour AM/PM period. One pulse of the panel A1 means the time is between 12 and 3, two pulses means the time is between 3:00 and 6:00, three pulses means the time is between 6:00 and 9:00, and four pulses means the time is between 9:00 and 12:00.

As shown in FIG. 4(*c*), the panels B1, B2, B3 may be black or clear. The number of clear panels represents a specific hour within the three hour quadrant identified by the A1 panel. One clear B panel means it is the first hour, two clear B panels means it is the second hour, and three clear B panels means it is the third hour. For example, assuming that panel A1 has pulsed twice, indicating that the time was in the second quadrant (e.g. between 3:00 and 6:00), if two B panels are clear when the panel A1 pulsed, then it is the second hour of the quadrant, that is, between 4:00 and 5:00.

After the panel A1 pulses, the B panels which are clear will pulse between one and four times (FIG. 4(*d*)) to indicate the 15 minute quadrant within the hour. Continuing the example of the previous paragraph, where two B panels were clear and the time is between 4:00 and 5:00, if those two B panels pulse twice, then it is the second 15 minute period within the hour, that is, between 4:15 and 4:30.

As shown in FIG. 4(*e*), the C panels may be black or clear. The number of clear C panels indicates the five minute period within the 15 minute period determined from the B panels. Continuing the example of the previous paragraph, if two C panel are clear, then it is the second five minute period within the 15 minute period, that is, between 4:20 and 4:25.

After the B panels pulse, the C panels which are clear will pulse between one and five times (FIG. 4(*f*)) to indicate a specific minute within a five minute period. Continuing the example of the previous paragraph, if the clear C panels pulse twice, then it is the second minute within the five minute period determined above, that is, between 4:22 and 4:23.

Example #1

An observer of the clock painting is served well by a general idea of the time neighborhood.

Frequently a person looking at the clock-painting of the present invention will begin interpreting the information contained in the clock-painting by starting with a rough idea of what three hour quadrant of an AM or PM period they are in and will not need a level of precision greater than five minutes. For example, a user suspects that the time is between 3:00 and 6:00 PM. It might be past 6:00 but not by much. By counting the number of clear B panels, the observer will know which hour it is. Further suppose that the observer knows whether the time is between 4:00 and 5:00, or between 7:00 and 8:00. If the observer knows that it is not yet as late as 7:00 then it must be between 4:00 and 5:00. If those two B panels pulse three times the observer knows that it is between 4:45 and 5:00. Now all that remains is to count the number of clear C panels (which can be done while waiting for the B panel pulses to begin) and the time will be known to within five minutes.

Conclusion

There are many possible variations and modifications which may be made to the clock-painting of the present invention. For example, if multi-color LCDs were used in place of black and clear, and each color were assigned a number in order of its occurrence in optical spectrum, it would be unnecessary to pulse the display. The clock-painting would continuously and instantaneously display the correct time, rather than requiring a time-consuming data extraction process.

The clock-painting may use display means other than LCDs. For example, LEDs, laser diode arrays, incandescent lights, or electroluminescent displays can be incorporated into a clock-painting and operate so as to embed time-of-day information into a dynamically changing piece of decorative art.

Although the present invention has been described in terms of the presently this embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A method of digitally displaying time-of-day information with color-coded images (including black and white) visually generated for human interpretation by an electronic display device, the method comprising the steps of:

indicating a time-of-day as being ante meridian (AM) or post meridian (PM) time by digital switching a first color-coded image between a first color and a second color;

indicating an hour of said time-of-day by pulsing said first color-coded image between said first color and said second color to represent a three hour quadrant within a larger twelve hour AM/PM period;

refining the indicating of said hour of said time-of-day by digitally switching a second, a third, and a fourth color-coded image between said first color and said second color such that one to all three of said second through fourth color-coded images are switched to display said first color and the remainder are switched to display said second color to represent a first, second, or third specific hour representing said time-of-day within said three hour quadrant;

indicating a minute-of-said-hour of said time-of-day by pulsing at least one of said second, third and fourth color-coded images one through four times between said first and said second color to represent a first through fourth fifteen minute quadrant of an hour;

refining the indicating of said minute of said minute-of-said-hour of said time-of-day by digitally switching a fifth, a sixth, and a seventh color-coded image between said first color and said second color such that one to all three of said fifth through seventh color-coded images are switched to display said first color and the remainder are switched to display said second color to represent a first, second or third five minute period within said fifteen minute quadrant; and further refining the indicating of said minute of said minute-of-said-hour of said time-of-day by pulsing at least one of said fifth, sixth and seventh color-coded images one to five times between said first and second colors to represent a specific minute within said specific five minute period wherein said time-of-day is displayed for interpretation by a human observer.

2. The method of claim 1, wherein the steps of indicating, refining and further refining are such that said first and second colors comprises a clear state and a dark state indication by a liquid crystal display (LCD) device.

3. The method of claim 1, wherein the steps of indicating, refining and further refining are such that said first, second, third, fourth, fifth, sixth and seventh color-coded images comprise at least one liquid crystal display.

4. The method of claim 1, wherein the steps of indicating, refining and further refining are such that said first, second, third, fourth, fifth, sixth and seventh color-coded images comprise at least one electroluminescent display.

5. The method of claim 1, wherein the steps of indicating, refining and further refining are such that said first, second, third, fourth, fifth, sixth and seventh color-coded images comprise incandescent lights.

6. The method of claim 1, wherein the steps of indicating, refining and further refining are such that said first, second, third, fourth, fifth, sixth and seventh color-coded images comprise light emitting diodes.

7. The method of claim 1, wherein the steps of indicating, refining and further refining are such that said first, second, third, fourth, fifth, sixth and seventh color-coded images comprise in combination an illumination source and a light valve.

8. The device of claim 7, wherein:

the steps of indicating, refining and further refining are such that said illumination source is selected from the group including laser diodes, incandescent light, electroluminescent light sources, and light emitting diodes; and the steps of indicating, refining and further refining are such that said light valve is selected from the group including ferro-electric liquid crystals, twisted-nematic liquid crystals, super-twisted liquid crystals, dichroic liquid crystals, reflective liquid crystals and transmissive liquid crystals.

9. A method of encoding and communicating time-of-day information for interpretation by a human observer a visual display, the method comprising the steps of:

partitioning and displaying on an electronic display panel a color-coded digital representation of a 24-hour period into two first subunits each of which are a digital representation of a 12 hour period;

partitioning and displaying on said electronic display panel each of said first subunits into four second subunits each of which are a digital representation of a three hour period;

partitioning and displaying on said electronic display panel each said second subunit into three third subunits each of which are a digital representation of a one hour period;

partitioning and displaying on said electronic display panel each said third subunit into four fourth subunits each of which are a digital representation of a fifteen minute period;

partitioning and displaying on said electronic display panel each said fourth subunit into three fifth subunits each of which are a digital representation of a five minute period; and partitioning and displaying on said electronic display panel each said fifth subunit into five sixth subunits each of which are a digital representation of a one minute period.

10. A clock-painting device for indicating a time-of-day in a non-traditional, non-analog artistic panel, comprising:

liquid crystal display (LCD) means including a first through a third type of digitally-controlled areas in which an hour of the time-of-day is communicated by said first and second areas and in which a minute of the time-of-day is communicated by said second and third areas;

AM/PM control means for maintaining a steady state condition of said first digitally-controlled area according to whether the time-of-day is AM or PM;

hour-quadrant control means for periodically blinking said first digitally-controlled area according to which three-hour quadrant of a twelve hour period is relevant to the time-of-day;

hour control means for maintaining a steady state condition of said second digitally-controlled area according to whether a first, second or third hour of said three-hour quadrant is relevant to the time-of-day;

minute-quadrant control means for periodically blinking said second digitally-controlled area according to which fifteen-minute quadrant of said first, second or third hour is relevant to the time-of-day;

five-minute control means for maintaining a steady state condition of said third digitally-controlled area according to whether a first, second or third five-minute period of said fifteen-minute quadrant of said hour is relevant to the time-of-day; and one-minute control means for periodically blinking said third digitally-controlled area according to which one-minute of said five-minute period is relevant to the time-of-day.

11. The device of claim 10, wherein:

said first digitally controlled area comprises an image of a single first disc in a center of a visual field included in the LCD means;

said second digitally controlled area comprises an image of a set of three second discs each smaller in area than said first disc and distributed around a periphery of said visual field included in the LCD means; and said third digitally controlled area comprises an image of a set of three third discs each smaller in area than said second discs and distributed around said periphery of said visual field included in the LCD means.

12. The device of claim 10, wherein:

said blinking is related such that one blink indicates a first hour in a three-hour quadrant, or a first fifteen-minute period in an hour, or a first minute in a five-minute period;

said blinking is related such that two blinks indicate a second hour in a three-hour quadrant, or a second fifteen-minute period in an hour, or a second minute in a five-minute period;

said blinking is related such that three blinks indicates a third hour in a three-hour quadrant, or a third fifteen-minute period in an hour, or a third minute in a five-minute period; and said blinking is related such that five blinks indicates a fifth minute in a five-minute period.

13. A method of digitally displaying time-of-day information with color-coded images visually generated for human interpretation by an electronic display device, the method comprising the steps of:

indicating an hour of a time-of-day by changing said first color-coded image between a first color through a fourth color to represent a three-hour quadrant within a larger twelve hour AM/PM period;

refining the indicating of said hour of said time-of-day by changing a second, a third, and a fourth color-coded image between said first through fourth colors such that one to all three of said second through fourth color-coded images are switched to display said first through fourth colors and the remainder are switched to display another of said first through fourth colors to represent a first, second, or third specific hour representing said time-of-day within said three-hour quadrant;

indicating a minute-of-said hour of said time-of-day by changing at least one of said second, third and fourth color-coded images between said first through fourth color to represent a first through fourth fifteen-minute quadrant of an hour;

refining the indicating of said minute of said minute-of-said-hour of said time-of-day by changing a fifth, a sixth, and a seventh color-coded image between said first color through said fourth color and a fifth color such that one to all four of said fifth through seventh color-coded images are switches to display said first through fifth colors and the remainder are switched to display another of said first through fifth colors to represent a first, second or third five-minute period within said fifteen-minute quadrant; and further refining the indicating of said minute of said minute-of-said-hour of said time-of-day by changing at least one of said fifth, sixth and seventh color-coded images between said first through fifth colors to represent a specific minute within said specific five-minute period wherein said time-of-day is displayed for interpretation by a human observer.

* * * * *